United States Patent [19]

Wilson et al.

[11] 4,222,542

[45] Sep. 16, 1980

[54] END PANEL MOUNT WITH SAFETY LOCK

[75] Inventors: Harold R. Wilson, Holland; Ronald D. Ten Elshof, Grandville, both of Mich.

[73] Assignee: Haworth Mfg., Inc., Holland, Mich.

[21] Appl. No.: 964,131

[22] Filed: Nov. 27, 1978

[51] Int. Cl.[2] ..... A47G 29/02

[52] U.S. Cl. ..... 248/243; 248/221.3; 211/192; 312/263

[58] Field of Search ..... 312/263, 245; 248/243, 248/221.3, 222.1, 73, 551, 544; 52/36; 211/192

[56] References Cited

U.S. PATENT DOCUMENTS

| | | | |
|---|---|---|---|
| 857,543 | 6/1907 | Thomas | 248/243 |
| 977,609 | 12/1910 | Freeman | 248/243 |
| 2,127,280 | 8/1938 | Zimbalist | 248/243 |
| 2,576,865 | 11/1951 | Vanderveld | 248/243 |
| 2,839,350 | 6/1958 | Hill et al. | 248/243 |
| 3,039,727 | 6/1962 | Engel, Jr. et al. | 248/551 |
| 3,066,902 | 12/1962 | Conil | 248/73 |
| 3,291,319 | 12/1966 | Novales et al. | 248/243 |
| 3,510,010 | 5/1970 | Gasner | 211/192 |
| 3,601,432 | 8/1971 | Fenwick | 248/243 |
| 3,612,290 | 10/1971 | Evans | 211/192 |
| 3,697,034 | 10/1972 | Shell | 248/243 |
| 3,886,698 | 6/1975 | Raith et al. | 52/36 |
| 3,895,774 | 7/1975 | Sharp | 248/243 |
| 3,966,158 | 6/1976 | Boundy | 248/243 |
| 4,048,768 | 9/1977 | Good | 248/243 |
| 4,055,318 | 10/1977 | Duckett | 248/243 |

*Primary Examiner*—Victor N. Sakran

*Attorney, Agent, or Firm*—Blanchard, Flynn, Thiel, Boutell & Tanis

[57] ABSTRACT

A bracket for attaching a component to a slotted upright, which bracket includes one or more conventional downwardly-opening L-shaped hooks adapted for engagement with the slots of the upright. The bracket includes an integral locking element which is sufficiently resilient to snap into one of the slots when the bracket is properly seated to thereby indicate proper engagement of the bracket on the upright, and simultaneously prevent upward lifting of the bracket relative to the upright. The locking element comprises a vertically elongated cantilever spring having a slot-engaging projection at the outer end thereof. The locking element is integral with the bracket and formed of the same plate-like material so as to be stiff yet slightly resilient, thereby ensuring positive seating of the locking projection within the slot when the bracket is properly seated on the upright.

9 Claims, 4 Drawing Figures

END PANEL MOUNT WITH SAFETY LOCK

FIELD OF THE INVENTION

This invention relates to an improved bracket structure for attaching a component to a slotted upright to ensure that the component is positively locked to the upright.

BACKGROUND OF THE INVENTION

Shelves and the like have conventionally been supported on slotted uprights by utilizing brackets which employ a plurality of vertically spaced, L-shaped hooks which project through a plurality of spaced slots in the upright. While this basic bracket-and-upright structure cooperates in a desirable manner to provide both strength and convenience of assembly, nevertheless this structure has proven undesirable in many instances. One of the primary disadvantages of this structure is the inability to insure that the brackets are securely seated on the upright. In many instances the brackets are improperly seated and, in time, may fall off of the upright or may become accidentally dislodged due to application of an upward external force thereto. This is obviously undesirable since not only is it damaging to the component, but it can also be harmful to personnel in the vicinity.

In an attempt to eliminate this disadvantage, numerous brackets have been devised which provide a positive lock between the bracket and upright, which lock normally employs a spring-type locking element or detent engageable with one of the slots to prevent upward movement of the bracket, and hence prevent dislodgement thereof from the upright. Other known brackets, other than relying on a spring lock, have instead provided a separate lock movably supported on the bracket and normally manually movable either by sliding or hinging thereof into a locking relationship with the bracket. Examples of several conventional brackets and systems employing locking features are illustrated in U.S. Pat. Nos. 3,697,034 (Shell), 977,609 (Freeman), 2,127,280 (Zimbalist), 857,543 (Thomas), 2,576,865 (Vanderveld), 3,895,774 (Sharpe), and 3,966,158 (Boundy).

While known structures of the above type have proven satisfactory with respect to their ability to lock the bracket to the upright, nevertheless these known structures possess other disadvantages which have made their use less than satisfactory, or have prevented or greatly restricted their utilization in various environments. For example, brackets which utilize a separate hinging or sliding lock member have proven undesirable since the lock member must normally be manually actuated, rather than resulting in an automatic locking of the bracket to the upright. These structures also require more extensive and expensive fabrication and assembly techniques. The use of a separate lock member of this type also normally results in the lock member being of substantial size, with the lock member also being positioned so as to be readily available for actuation, and hence the lock member is undesirably visible at all times and hence is unacceptable for use when the bracket is associated with furniture components and the like. Further, when the bracket is continuously visible, this makes the bracket more susceptible to being accidentally released due to the lock member being accidentally released by persons who are not knowledgeable as to the operation of the structure involved.

Further, most of the known structures, including those involving the use of automatically engageable spring-type locking elements, have been undesirably large and hence unsightly, and have also been normally positioned for visibility and/or accessibility at all times, thereby facilitating the release thereof and hence the accidental disconnection of the bracket from the upright. These structures have also normally required fabrication and assembly of a spring to the bracket, and hence have substantially increased the cost and complexity of the overall assembly.

Accordingly, the present invention relates to an improved bracket having an automatically engageable locking element associated therewith to positively lock the bracket to the upright, which bracket overcomes the numerous disadvantages mentioned above.

More specifically, the present invention relates to an improved bracket for attaching a component to a slotted upright, which bracket includes one or more conventional downwardly-opening L-shaped hooks adapted for engagement with the slots of the upright, and also includes an integral locking element which is sufficiently resilient so as to snap into one of the slots when the bracket is properly seated to thereby indicate proper engagement of the bracket on the upright and simultaneously prevent upward lifting of the bracket relative to the upright. The locking element comprises an elongated cantilever spring having a slot-engaging hook or projection at the outer end thereof. The locking element is integral with the bracket and formed of the same platelike material so as to be relatively stiff yet slightly resilient, thereby ensuring positive seating of the locking projection within the slot when the bracket is properly seated on the upright, while at the same time facilitating the manufacture of a simple and inexpensive bracket.

Another object of the invention is to provide an improved bracket, as aforesaid, which can be automatically and positively locked to the upright while at the same time being disposed so as to be totally hidden between the upright and the supported component, hence preventing the accidental release of the locking element and at the same time providing a pleasing visual and aesthetic appearance. The bracket and the integral spring-lock of this invention, so as to achieve this desirable advantage, is extremely small and compact.

A further object of this invention is to provide an improved bracket, as aforesaid, which is particularly desirable for mounting a furniture component such as a bookshelf, file cabinet or the like to an upright space-divider panel of the type used in offices and the like, whereby the shelflike component is provided with a pair of spaced end panels which each have a bracket associated therewith for attaching the end panels to the slotted posts or uprights associated with the opposite vertical edges of the space-divider panel. The improved bracket of this invention is particularly desirable for use in this environment since the bracket provides for positive locking of the furniture component to the space-divider panel, while at the same time the bracket is extremely small and compact so as to be totally hidden from view and hence not destroy the aesthetics of the assembled office furnishings. The bracket of this invention also preferably incorporates a simplified, yet hidden structure to simplify release thereof when disassembly of the furniture component from the space-divider panel is desired, which release can be effected by utilization of a simplified tool such as a screw driver or the like.

Other objects and purposes of the invention will be apparent to persons familiar with structures of this general type upon reading the following specification and inspecting the accompanying drawings.

Figure 1:
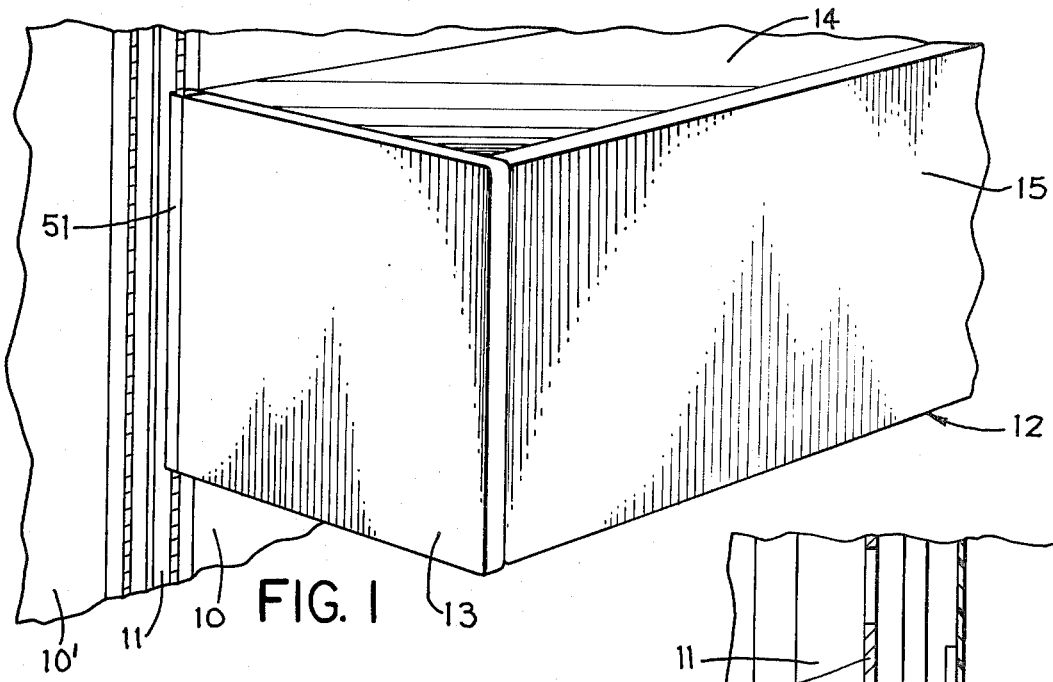
FIG. 1 is a fragmentary perspective view illustrating a conventional furniture component, such as a closed storage cabinet, mounted in a cantilevered fashion on one side of one series-connected space-divider panel.

Certain terminology will be used in the following description for convenience in reference only and will not be limiting. For example, the words "upwardly", "downwardly", "leftwardly" and "rightwardly" will refer to directions in the drawings to which reference is made. The words "upwardly" and "downwardly" will also be used with reference to the upper and lower ends of the bracket and of the associated space-divider panel, when oriented in the conventional operational position. The words "inwardly" and "outwardly" will refer to directions toward and away from, respectively, the geometric center of the bracket and associated mounting structure, and designated parts thereof. Said terminology will include the words specifically mentioned, derivatives thereof and words of similar import.

DETAILED DESCRIPTION

FIG. 1 illustrates a pair of substantially identical, portable, upright space-divider panels 10 and 10' which have their adjacent edges series connected. The structure of these panels, and their usage in offices and the like, is well known.

The panel 10 has a pair of slotted uprights 11 disposed adjacent the opposite vertical edges thereof, only one such upright being illustrated in FIG. 1. A shelf-like furniture component 12 is attached to the panel 10, as by being connected to the slotted uprights 11, so that the shelflike component is thus positioned adjacent one side of the panel and projects outwardly therefrom in a cantilevered relationship. In the illustrated embodiment, the component 12 comprises a closed file cabinet of conventional construction in that it includes a pair of opposed end panels, such as the end panel 13, which are joined together by a bottom shelf (not shown). The illustrated component 12 also includes a top wall 14 and a movable or openable front cover 15. A component of this general type is disclosed in U.S. Pat. No. 3,771,847.

While the component 12 is illustrated as a closed cabinet, it will be appreciated that numerous other types of components such as bookshelves and lateral files can also be mounted on a wall panel in the same manner as the component 12, and hence the present invention is equally applicable to any such component as adapted for attachment to the side of a wall panel.

The attachment of component 12 to wall panel 10 is conventionally accomplished by providing a bracket which projects rearwardly from the rear edge of each end panel 13, which bracket conventionally employs a plurality of vertically spaced, downwardly directed L-shaped hooks which project through the vertically spaced slots in the upright. This conventional bracket structure has possessed the numerous disadvantages discussed above.

Figure 4:
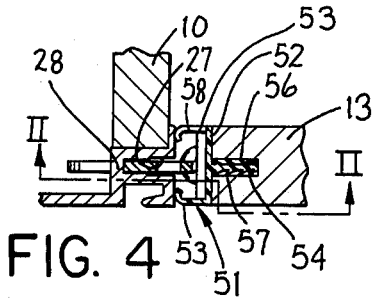
FIG. 4 is a fragmentary sectional view taken along line IV—IV in FIG. 2.
Figure 3:
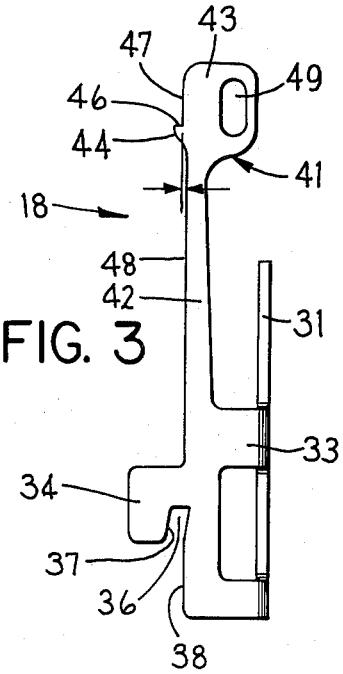
FIG. 3 is a side elevational view illustrating solely the bracket in a normal relaxed or nondeflected condition.
Figure 2:
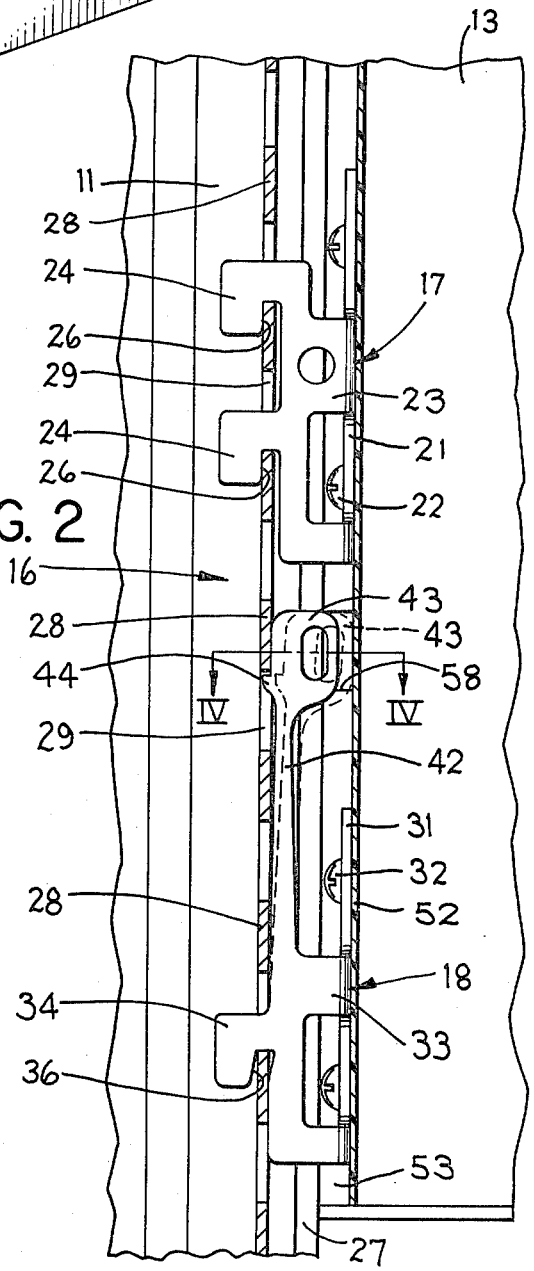
FIG. 2 is an enlarged, fragmentary sectional view showing the bracket secured to an end panel of a furniture component and releasably connected to a slotted upright, this view being taken substantially along line II—II in FIG. 4.

Referring now to FIGS. 2–4, the present invention relates to an improved bracket structure 16 which is secured to the rear edge of the end panel 13 and is disposed for attachment to the slotted upright 11. This bracket structure 16, in the illustrated embodiment, is formed by upper and lower brackets 17 and 18, respectively.

The upper bracket 17 includes a base plate 21 which overlies the rear edge of end panel 13 and is fixed thereto, as by screws 22. A hook plate 23 projects rearwardly from the center of the base plate and terminates in a plurality of downwardly opening L-shaped hooks 24. These hooks define downwardly opening slots 26.

To accommodate the upper and lower brackets, the upright 11 has a narrow slotlike recess 27 formed therein and opening horizontally outwardly through the front wall thereof, which recess extends vertically in the longitudinal direction of the upright. This recess terminates in a rear wall 28 which has a plurality of vertically spaced slots 29 extending therethrough, which slots permit the hooks 24 to pass therethrough to thereby secure the upper bracket 17 to the upright, as illustrated in FIG. 2.

The structure of the upper bracket 17, and its functional and operative relationship with the slotted upright 11, is substantially conventional.

Considering now the lower bracket 18, same includes a base plate 31 which overlies and is fixed to the rear edge of end panel 13, as by screws 32. A hook plate 33 extends rearwardly from the center of the base plate 31 in substantially perpendicular relationship therewith. This hook plate 33 terminates, in the illustrated embodiment, in at least one downwardly opening L-shaped hook 34 which defines a downwardly opening slot 36. The hook 34, like the hooks 24 described above, is adapted to extend through one of the upright slots 29 so as to enable the hook slot 36 to receive therein the rear wall 28. The hook slot 36, however, preferably has the opposed substantially parallel sidewalls 37 thereof extending forwardly at a slight angle relative to the vertical. This angular relationship of slot 36 thus causes the wall 28 to be wedged and hence securely held within the slot 36, whereby the lower rear edge 38 of hook plate 33 is drawn into snug bearing engagement with the front surface of the rear wall 28, as illustrated in FIG. 2.

The lower bracket 18 also has a locking member 41 integrally associated therewith. This locking member 41 includes an elongated spring arm 42 which is formed integral and vertically coplanar with the hook plate 33, and projects upwardly a substantial distance above the hook 34. This spring arm 42 terminates in an enlarged locking portion 43 which, on the rear side thereof, defines a rearwardly projecting locking tab 44. This tab defines a flat upper surface 46 which extends in substantially perpendicular relationship to the flat rear edge 47 defined by the enlarged locking portion 43. This latter rear edge 47 is in turn spaced rearwardly a small distance from the rear edge 48 of the spring arm 42. This rear edge 48 is in turn substantially vertically aligned with the lower rear edge 38.

The locking portion 43 also has an opening 49 formed therethrough for permitting insertion of a tool.

The lower bracket 18 is preferably formed as one integral piece, as by being suitably formed from a flat sheet of high-strength alloy steel, and then being suitably bent so as to form the base and hook plates, which plates extend in substantially perpendicular relationship to one another within substantially vertical planes. By so constructing the lower bracket, the spring arm 42 will thus have sufficient resiliency to enable the locking portion 43 to be resiliently deflected rearwardly substantially as illustrated by dotted lines in FIG. 2.

To fully enclose the brackets and hence improve the overall appearance of the component 12 when mounted on the uprights 11, there is provided a resilient closure strip 51 secured to the rear edge of the end panel 13. This resilient closure strip 51 is, in the illustrated embodiment, formed as a vertically elongated channel-like element having a base part 52 which overlies and extends vertically along the rear edge of the end panel 13. A pair of resilient legs 53 extend rearwardly from the base part 52 and terminate in curved portions at the free ends thereof, which curved portions are adapted to resiliently bear against the front wall of the upright 11, as illustrated in FIG. 4. A vertically elongated flange 54 is formed integral with the base part 52 and projects rearwardly from the center thereof. This flange projects into a vertically elongated central slot 56 formed in the end panel 13. The flange 54 has a plurality of resilient tangs or projections 57 extending outwardly from opposite sides thereof, which tangs 57 act as locking members and hence hold the flange 54 within the slot 56.

The innermost resilient leg 53, that is the leg which is positioned and hence accessible solely from inside the cabinet 12, has a cutout or opening 58 formed therein at an elevation directly opposite the enlarged locking portion 43. This thus permits a tool, such as a screw driver or the like, to be inserted through the cutout 58 so as to enter into the opening 49 formed in the enlarged locking portion 43 when release of the bracket 18 from the upright 11 is desired.

The operation of the improved bracket structure of this invention is believed obvious from the above structural description.

When the cabinet 12 is to be attached to the wall panel 10, the cabinet 12 is positioned so that the bracket structures 16 associated with the opposite end panels 13 thereof are directly in front of the slotted uprights 11 as located adjacent the opposite edges of the panel. The cabinet and hence the bracket structures are moved rearwardly into the recesses 27 so that the hooks 24 and 34 pass through the slots 29. Thereafter the cabinet is forced downwardly so that the rear wall 28 enters into the slots 26 and 36. Due to the inclined configuration of the lower slot 36, the lower bracket 18 is cammed rearwardly so that the lower rear edge 38 substantially snugly bears against the front surface of the rear wall 28.

During the initial insertion of the hooks 24 and 34 through the slots 29, as above described, the locking tab 44 will be positioned between the slots 29 and hence will engage the rear wall 28. As the brackets are forced rearwardly so as to enable them to fully pass through the slots 29, the locking portion 43 is resiliently deflected forwardly due to the resilient deflection permitted by the elongated spring arm 42. As the cabinet is then forced downwardly so as to cause the rear wall 28 to enter into the slots 26 and 36, the lower rounded cam surface formed on the projection 44 slides downwardly along the rear wall 28. When the brackets are substantially fully seated on the upright, such as when the rear wall 28 extends substantially fully into the slots 26 and 36, then the locking tab 44 is aligned with one of the slots 29, and hence the spring arm 42 resiliently returns the locking portion 43 rearwardly so that it assumes the position illustrated by solid lines in FIG. 2, in which position the upper surface 46 on the locking tab 44 is disposed within one of the slots 29 directly below the wall 28. Any tendency for the bracket structure, and hence the cabinet, to move upwardly is thus positively resisted due to the abutting of the surface 46 against the lower edge of the rear wall 28. Accidental dislodgment of the cabinet from the uprights is hence positively prevented.

When the locking tab 44 is in the locking position illustrated in FIG. 2, the arm 42 is still slightly resiliently deflected, and hence the rear edge 47 of the locking portion 43 snugly bears against the front surface of the rear wall 28. This relationship exists inasmuch as the rear edge 47 of the locking portion is offset rearwardly a slight distance from the rear edges 48 and 38, as described above. The resilient arm 42 thus always resiliently urges the locking portion 43 against the rear wall 28, and hence always maintains the locking tab 44 in its locking position, thereby preventing accidental release of the bracket from the upright.

The resilient closure strips 51 totally enclose the brackets and hence prevent their visibility when the cabinet is mounted on uprights. Because the brackets are not visible when being seated on the uprights, the installer will be able to determine when proper seating of the brackets occur inasmuch as the resilient deflection of the locking portion 43 into its locking position will create an audible noise, such as a "click" when it resiliently moves or snaps into its locking position. When release of the cabinet is desired, then this can be easily accomplished by inserting a screw driver or like tool from inside the cabinet through the cutout 58 into the opening 49, whereupon the locking projection 43 can then be resiliently deflected forwardly into the dotted line position illustrated in FIG. 2, following which the cabinet and hence the brackets can be lifted upwardly so as to disengage the cabinet from the uprights.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In combination, a bracket structure for lockingly supporting an article on a slotted upright in a cantilevered relationship, said bracket structure being fixed to said article and including a plurality of rigid rearwardly-projecting downwardly-opening load-supporting L-shaped hooks disposed for engagement with the slotted upright, the improvement wherein said bracket structure comprises a one-piece bracket member which is fixed to said article and includes a rigid and substantially planar hook plate which terminates in at least one said hook, said hook plate being disposed within a substantially vertical plane, said bracket member also including locking means integrally associated therewith and engageable with one of the slots of said upright for automatically locking said bracket member to said upright only when said one hook is properly seated on the upright to thereby prevent accidental upward movement of the bracket member relative to the upright, said locking means including a substantially straight elongate cantilevered spring arm which is integrally fixed at one end thereof to said bracket member, said spring arm extending substantially vertically in approximately parallel relationship to said slotted upright and having a rearwardly-projecting locking tab provided adjacent the free end thereof so that said locking tab is movably urged substantially perpendicularly toward said slotted upright due to the urging of said spring arm, said locking tab having an upwardly-facing stop surface adapted to be disposed directly below a downward-facing surface on said upright, said spring arm resiliently urging said locking tab rearwardly into one of said slots when said one hook is positioned and properly seated within its respective slot, and said locking tab being vertically spaced a preselected distance from said one hook so that said locking tab is automatically resiliently inserted into its respective slot only when said one hook is fully seated within its slot, whereby said bracket member is mountable on said upright only by initially properly seating said one hook within its respective slot following which said locking tab is automatically moved into its respective slot to prevent upward movement of said bracket member.

2. A combination according to claim 1, wherein said spring arm is vertically coplanar with said hook plate and has an enlarged portion formed at the free end thereof, said enlarged portion having said locking tab projecting rearwardly therefrom, said enlarged portion also having a rear abutment surface adapted to be resiliently urged into engagement with a slotted wall of said upright when said locking tab is engaged within one of said slots, said enlarged portion also having opening means extending therethrough for permitting engagement thereof with a tool when release of said locking tab is desired.

3. A combination according to claim 2, wherein said hook plate has a vertically extending back edge located in the vicinity of said one hook and adapted to be moved into engagement with the slotted wall of said upright when the bracket member is secured thereto, and the rear edge of said enlarged portion being vertically spaced from said back edge and also being horizontally spaced rearwardly of said back edge by a small distance so that the spring arm is at least slightly resiliently deflected when the rear edge of said enlarged portion bears against the slotted wall of said upright, whereby said spring arm continuously resiliently urges the locking tab into its locking position.

4. A combination according to claim 3, wherein said bracket member is formed from a flat sheetlike alloy steel and includes a platelike base part which is fixedly attached to said article, said platelike base part being integral with and substantially perpendicular to said hook plate.

5. A combination according to claim 4, wherein the downwardly opening slot defined by said one hook is slightly inclined relative to the vertical for camming the bracket member rearwardly into engagement with the slotted wall of the upright as the bracket member is forced downwardly on the upright.

6. A combination according to claim 3, including a resilient closure strip fixed to the rear edge of said article and projecting rearwardly therefrom in surrounding relationship to said bracket member for engaging the front wall of said upright, said closure strip comprising a vertically elongated channel-like element having a base portion fixed to said article and rearwardly projecting resilient legs having the free ends thereof disposed in engagement with the front wall of said upright, one of said legs having a small opening formed therethrough directly adjacent said enlarged portion for permitting a tool to be inserted therethrough when release of said locking tab is desired.

7. In combination, a shelflike furniture component having a pair of horizontally spaced end panels each having a vertically extending rear edge, a bracket structure fixed to each end panel and projecting rearwardly from the rear edge thereof, and a pair of substantially parallel uprights each having a row of vertically spaced elongated slots formed in a wall thereof for engagement with said bracket structures to thereby fixedly mount said furniture component on said uprights in a cantilevered relationship, each said bracket structure including a plurality of rearwardly-projecting downwardly-opening L-shaped rigid hooks disposed in vertically spaced relationship and being insertable through individual slots formed in the respective upright for fixedly attaching the furniture component to the uprights, the improvement wherein each bracket structure comprises:

a one-piece bracket member fixedly attached to said end panel and projecting rearwardly thereof, said one-piece bracket member being formed from a flat sheetlike material of uniform thickness;

said bracket member, as fixed to the rear edge of said end panel, being disposed in its entirety between the upper and lower edges of said end panel so as to be substantially wholly confined between said end panel and said upright;

said bracket member including a substantially planar base portion disposed within a vertical plane and overlying the rear edge of said end panel, said base portion being fixedly secured to said end panel;

said bracket member including a substantially planar mounting portion disposed within a substantially vertical plane and extending rearwardly from said base portion in substantially perpendicular relationship thereto;

said planar mounting portion including a platelike part projecting rearwardly of said base portion and being positionable in front of the slotted wall of said upright, said platelike part having at least one of said L-shaped hooks projecting rearwardly therefrom;

said mounting portion also having locking means associated therewith for automatically engaging one of the slots of said upright only after said bracket member is properly seated on said upright to prevent accidental upward displacement of said bracket member relative to said upright, said locking means including a substantially straight and vertically elongated platelike cantilevered spring arm integral and coplanar with said platelike part, said spring arm being stiff and having a locking portion formed on the free end thereof so that said locking portion is vertically spaced a substantial distance from said one hook, said locking portion having a rearwardly projecting locking tab adapted to project into one of the slots of said upright which is not occupied by any of said hooks, said locking tab when projecting into said slot preventing upward displacement of said bracket member relative to said upright without first requiring that the locking tab be manually moved forwardly in opposition to the urging of said spring arm so as to be withdrawn from its respective slot.

8. A combination according to claim 7, wherein said bracket structure includes a second one-piece bracket member attached to said end panel and projecting rearwardly therefrom, said second bracket member being vertically spaced from said first-mentioned bracket member and having at least one of said L-shaped hooks projecting rearwardly therefrom, said spring arm projecting vertically toward said second bracket member so that said locking portion is disposed vertically between the hooks of said first-mentioned and second bracket members.

9. A combination according to claim 7, including a resilient closure strip fixed to the rear edge of each said end panel and projecting rearwardly therefrom in surrounding relationship to said bracket member for engaging the front wall of said upright, said closure strip comprising a vertically elongated channel-like element having a base portion fixed to said end panel and rearwardly projecting resilient legs having the free ends thereof disposed in engagement with the front wall of said upright, the inner one of said legs having a small opening formed therethrough directly adjacent said locking portion for permitting a tool to be inserted therethrough when release of said locking tab is desired.

* * * * *